US008100060B2

(12) United States Patent
Kuo

(10) Patent No.: US 8,100,060 B2
(45) Date of Patent: Jan. 24, 2012

(54) DUAL-PURPOSE TABLE WITH REVOLVING TOP

(75) Inventor: Kun-Fa Kuo, Guangdong (CN)

(73) Assignee: Juan Chen, Nancheng District, Dongguan, Guangdong Province (CN)

( * ) Notice: Subject to any disclaimer, the term of this patent is extended or adjusted under 35 U.S.C. 154(b) by 968 days.

(21) Appl. No.: 12/059,925

(22) Filed: Mar. 31, 2008

(65) Prior Publication Data

US 2009/0241806 A1 Oct. 1, 2009

(51) Int. Cl.
*A47F 5/12* (2006.01)

(52) U.S. Cl. ..... 108/6

(58) Field of Classification Search ..... 292/194, 292/200, 256.69, DIG. 31, DIG. 49; 108/6, 108/8, 9

See application file for complete search history.

(56) References Cited

U.S. PATENT DOCUMENTS

RE14,741 E * 10/1919 Anderson ..... 292/198
2,479,921 A * 8/1949 Gander ..... 292/223
2,621,952 A * 12/1952 Gander ..... 292/196
3,047,321 A * 7/1962 Gander ..... 292/223
4,943,040 A * 7/1990 Finstad et al. ..... 269/69
6,425,567 B2 * 7/2002 Schutze ..... 248/452
2005/0253491 A1 * 11/2005 Gilman ..... 312/305

* cited by examiner

*Primary Examiner* — Jose V Chen
*Assistant Examiner* — Matthew Ing
(74) *Attorney, Agent, or Firm* — Global IP Services; Tianhua Gu

(57) ABSTRACT

This invention relates to the technical area of sports and recreational apparatus, which reveals the dual-purpose and turnover ping-pong table. This dual-purpose table includes the table support and table surface, two sides of which are different tables. The center of short frame on both sides of the table surface hinges the baffle means on the upper end of the table support through the pivot components. Its characteristics lie in that the baffle means on the upper end of table support is equipped with the positioning device for table surface turning over, which has a stand bar that can be turned around. The stand bar can withdraw if the table surface needs turning around so that the table surface turn over. When the table surface has turned around, it can stretch out below the surface and stabilize the table surface. The structure is very simple and convenient for application.

4 Claims, 5 Drawing Sheets

DUAL-PURPOSE TABLE WITH REVOLVING TOP

FIELD OF THE INVENTION

This invention relates to sports and recreational apparatus, which specifically refers to a dual-purpose table with a revolving tabletop.

BACKGROUND OF THE INVENTION

The ping-pong table is a common sports and recreational apparatus, which is composed of a tabletop and the support on the two sides. In most cases, only one side of the tabletop can serve the purpose, which restricts their applicable range. There are some tables with tops, both sides of which serve different ball games. The user can turn over the table to play another kind of ball game. However, such dual-purpose ball tables with revolving tops in the market often have very complicated structure for the top revolving and positioning, which make it not very convenient to use. Further improvement is needed.

SUMMARY OF THE INVENTION

This invention aims to provide a dual-purpose ping-pong table with revolving tops, which is simply structured and convenient to use.

To achieve the above purpose, this invention includes the tabletop and the table supports. Both sides of the tabletop serve different kind of ball game. The short frame center on the two sides of the table hinge with the baffle means in the upper end of table supports through the pivot components. The baffle means in the upper end of the table supports is also equipped with positioning device for tabletop revolving, which has a revolving support bar. When the tabletop has turned over, the support bar stretches out and holds the tabletop from below to prevent its revolving.

The overturn positioning device as mentioned comprises the exterior frame and connecting bar structure, the latter including a panel and a hollow frame that protrudes from the panel rear. There is a groove where the panel center corresponds to the hollow frame. The connecting bar structure is installed in the containing chamber formed by the groove and hollow frame, which includes the wrench, support bar and the intermediate driving rod. The lower end of wrench sidewall hinges with that of the hollow frame sidewall. The support bar rear hinges with the center of hollow frame sidewall. The two sides of intermediate driving rod hinge respectively with the wrench sidewall and hollow frame sidewall. The horizontal position of the support bar is the dead center position of the connecting bar structure.

There is a curved groove in the upper end of the mentioned wrench for the user's convenience to pull the wrench.

Where the support bar rear hinges the hollow frame is a cylindrical roller. In the wrench sidewall, there is the curved notch where it corresponds to the cylindrical roller.

There are four overturn positioning device mentioned above. There are two such positioning devices on each of the table supports that connect with the short frame on the two sides of tabletop.

This invention has the beneficial effects as follows. The positioning device in the baffle means on the upper end of table support has a stand bar that can be turned around. The stand bar can withdraw if the table surface needs turning around so that the table surface turn over. When the table surface has turned around, it can stretch out below the surface and stabilize the table surface. The structure is very simple and convenient for application.

BRIEF DESCRIPTION OF THE DRAWINGS

Below is the further illustration to this invention together with the attached drawings.

DETAILED DESCRIPTION OF THE INVENTION

The following is a better implementation example of this invention, which thus is not limited to the protected scope of this invention.

Figure 1:
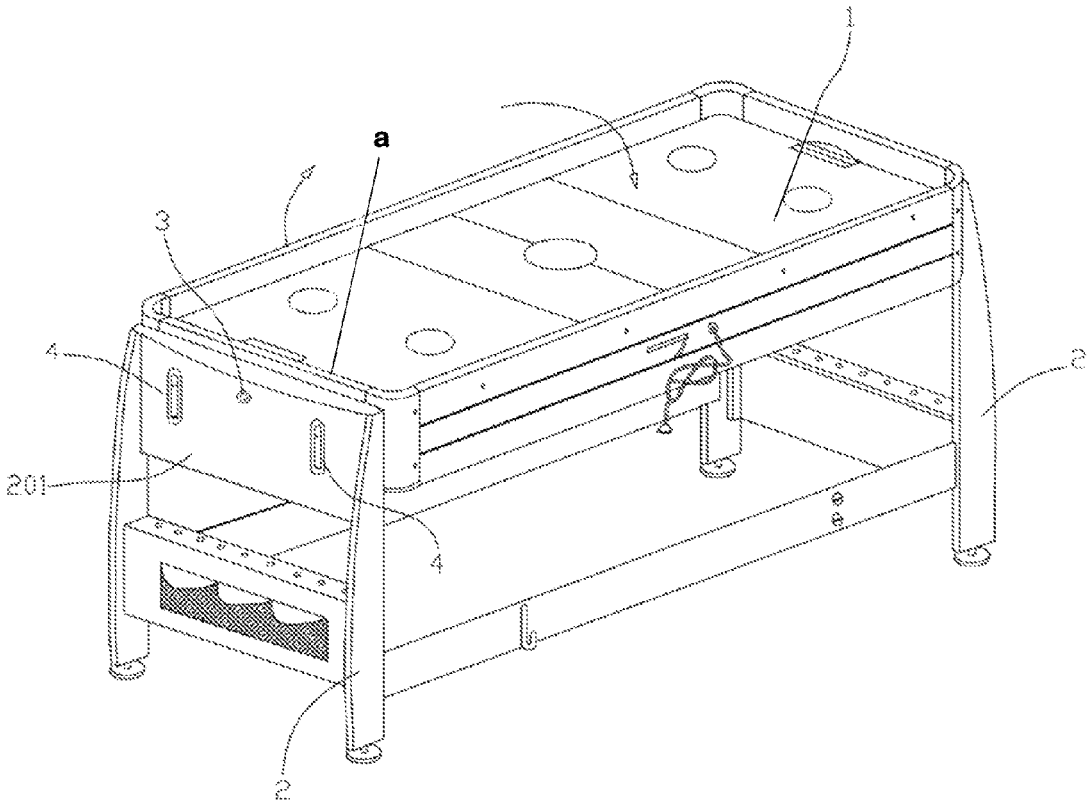
FIG. 1: showing the use of this invention.
Figure 2:
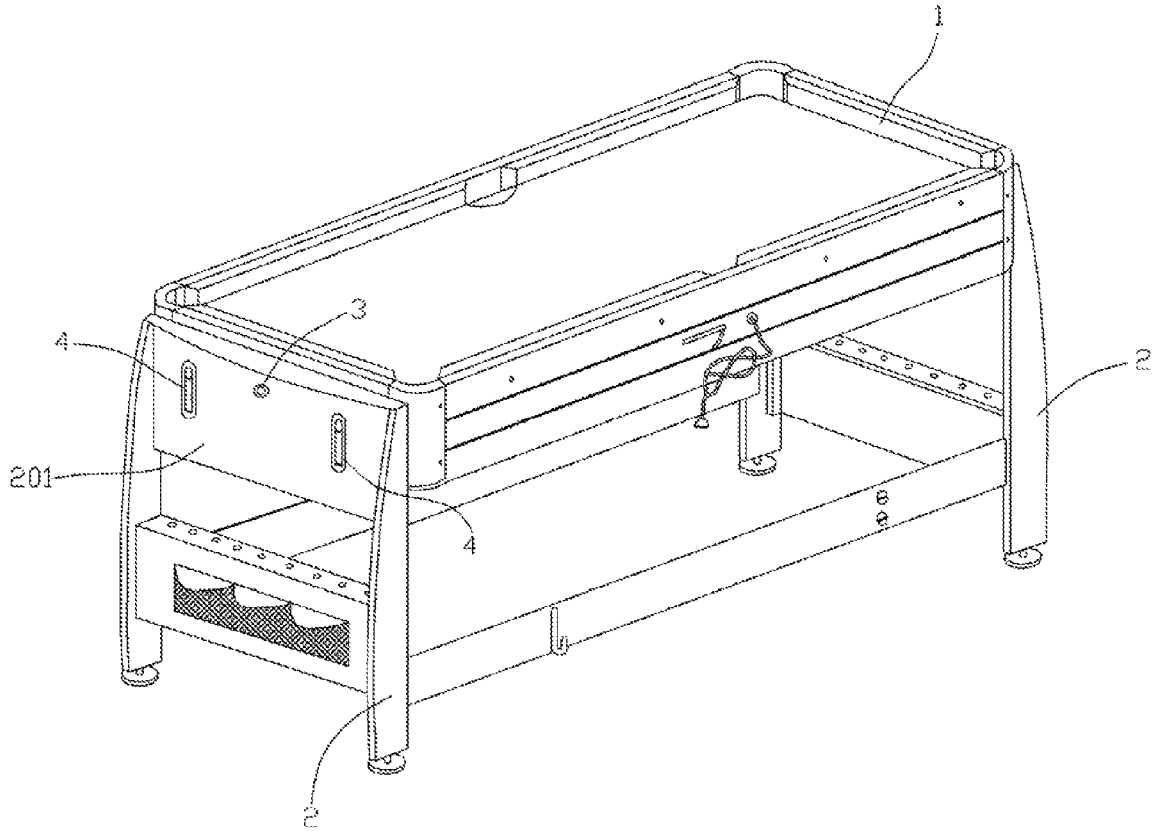
FIG. 2: showing the use of this invention.

As shown in FIG. 1 and FIG. 2; this practical new dual-purpose table has Tabletop 1 and Table Support 2. Two sides of Tabletop 1 serve different games (In FIG. 1, it is billiards table; in FIG. 2, it is). The short framework center on the two sides of Table 1 hinges with the baffle means 201 on the upper end of Table Support 2 through Pivot Component 3. Through Pivot Component 3, Table 1 can turn around Table Support 2; in addition, there is tabletop Overturn Positioning Device 4; there are four Overturn Positioning Devices 4; Overturn Positioning Device 4 has a revolving support bar. When Tabletop 1 has turned around, the support bar stretches out and holds the bottom of Tabletop 1 to prevent Tabletop 1 from turning.

Figure 3:
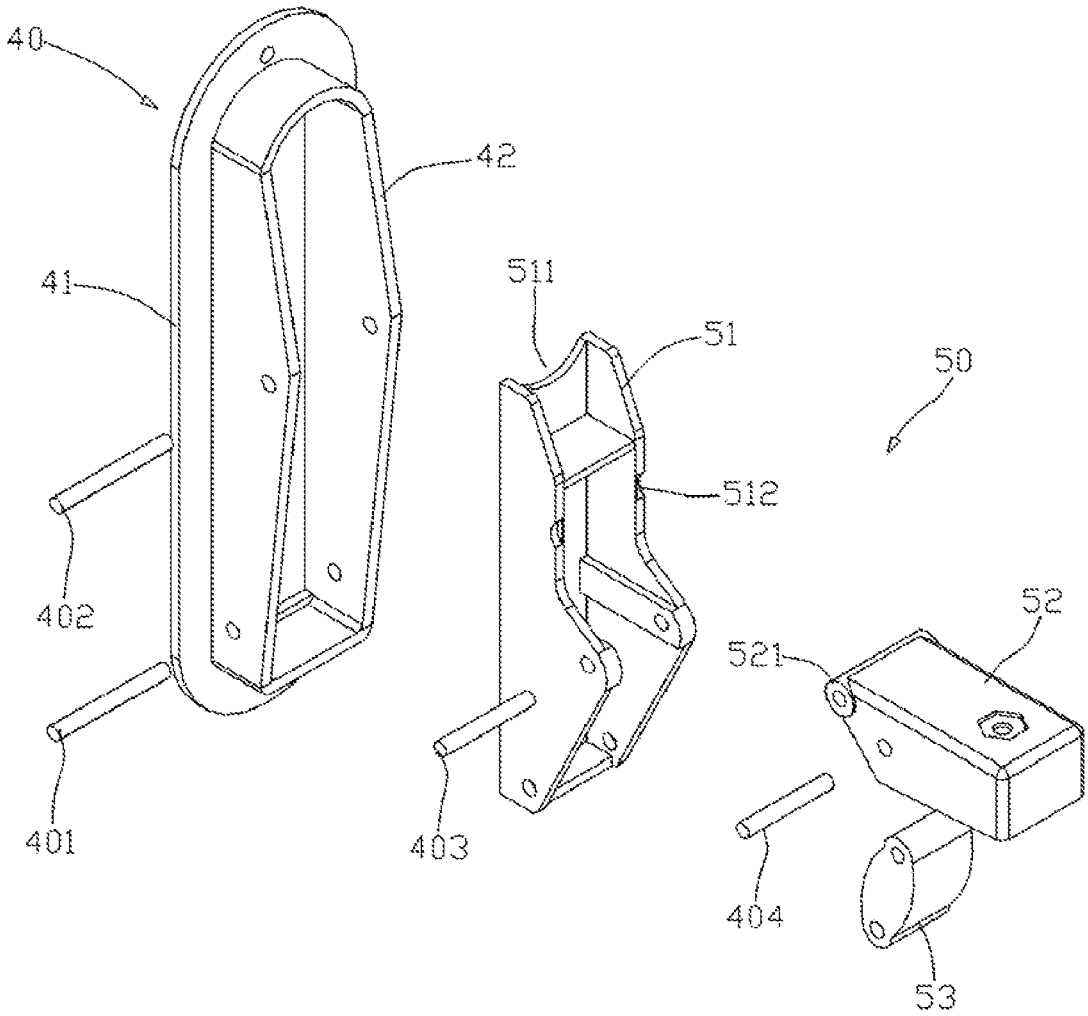
FIG. 3: showing the breakdown drawing of overturn positioning device of this invention.

As shown in FIG. 3, Overturn Positioning Device 4 is composed of Exterior Frame 40 and Bar Linkage 50, in which, Exterior Frame 40 includes Panel 41 and Hollow Frame 42 that protrudes out of the panel rear. In the middle of Panel 41, where it relates to Hollow Frame 42, there is a Groove 43; Bar Linkage 50 is located in the containing chamber formed by Groove 43 and Hollow Frame 4. Bar Linkage 50 includes Wrench 51, Support Bar 51 and Intermediate Driving Bar 53. The lower end of Wrench 51 and the lower end of Hollow Frame 42 sidewall are hinged through Pin Roll 401. The lower end of Wrench 52 and the lower end of Hollow Frame 42 sidewall are hinged through Pin Roll 402. Two ends of Intermediate Driving Bar 53 hinges with the sidewall of Wrench 51 and sidewall of Support Bar 52 through Pin Roll 403,404. A Curved Groove 511 is set on top of Wrench 51 so that it is convenient for users to pull Wrench 51. Additionally, there is a cylindrical Roller 521 where the rear of Support Bar 52 hinges with Hollow Frame 42. There is a Curved Notch 512 in the sidewall of Wrench 51 where it corresponds to Cylindrical Roller 521 to allow Support Bar 52 to revolve more flexibly.

Figure 4:
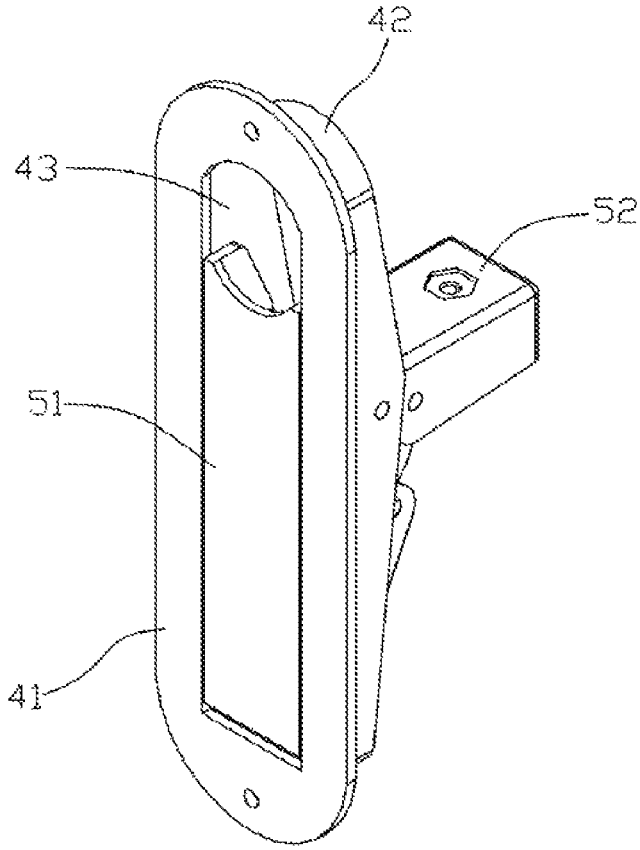
FIG. 4: showing the use of overturn positioning device of this invention (with the support bar protruding)
Figure 5:
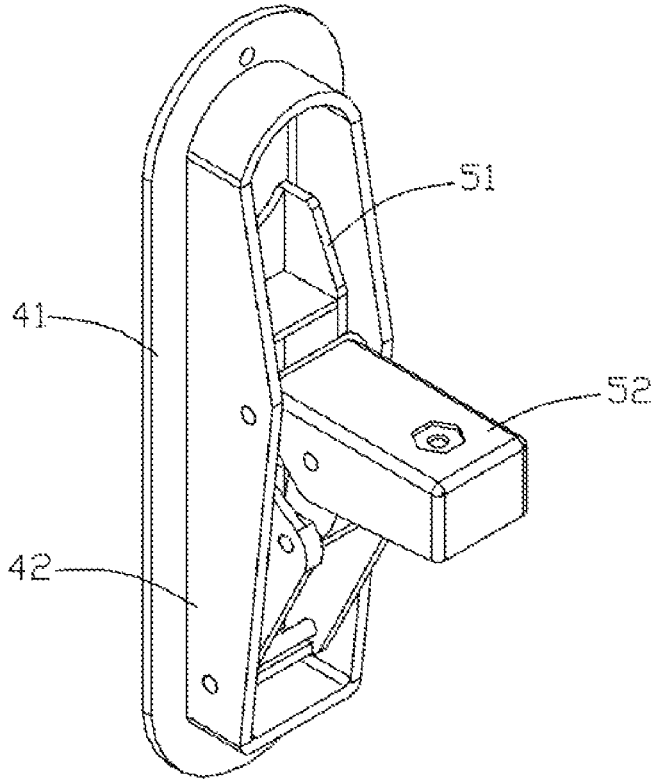
FIG. 5: showing the use of overturn positioning device of this invention (with the support bar protruding)

As shown in FIG. 4 and FIG. 5, when Tabletop 1 has turned around, it pushes Wrench 51 to Groove 43 of Panel 41. Now, Support Bar 52 in Bar Linkage 50 is horizontal and supports and positions Table 1, while the horizontal position of Support Bar 52 is the dead center position of bar linkage. The gravity from Tabletop 1 does not turn around Support Bar 52, which fixates the position of Tabletop 1.

Figure 6:
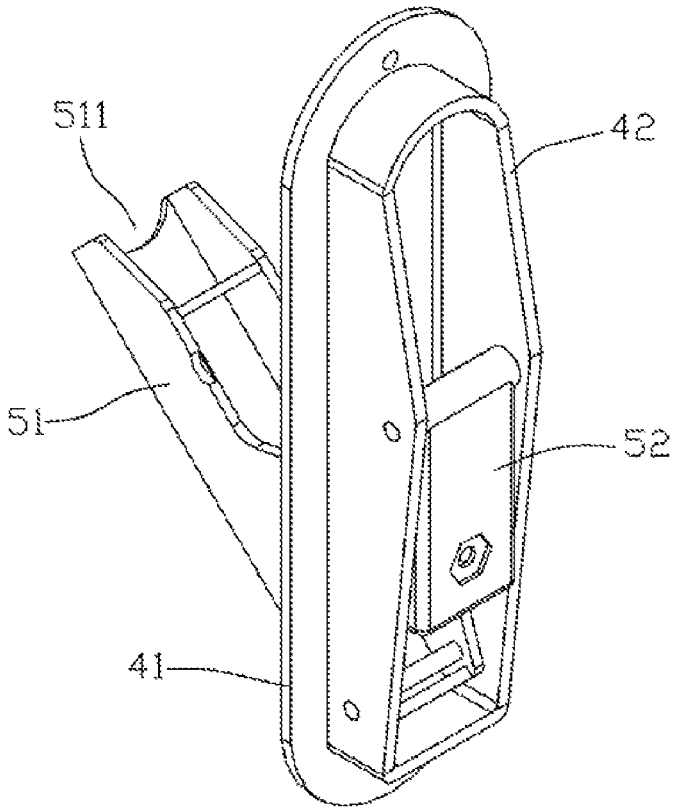
FIG. 6: showing the use of overturn positioning device of this invention (with the support bar protruding)
Figure 7:
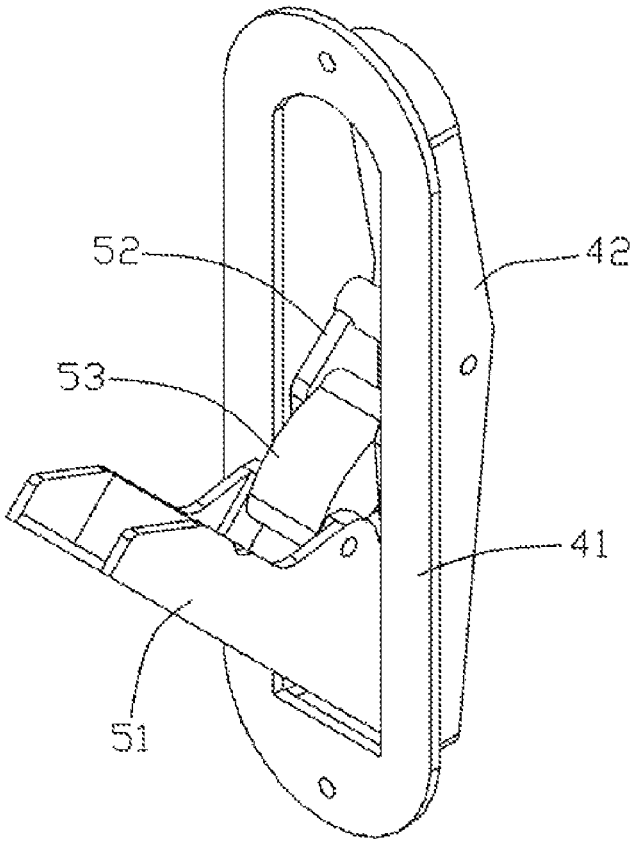
FIG. 7: showing the use of overturn positioning device of this invention (with the support bar protruding).

As shown in FIG. 6 and FIG. 7, if you want to turn over Tabletop 1, you can pull out Groove 43 by Wrench 51. Now, Wrench 51 turns around Support Bar 52 through Intermediate Driving Bar 53 to have Support Bar 52 withdraw back inside Hollow Frame 42, whose binding of Tabletop 1 is released. Tabletop 1 then can revolve around the center of Pivot Component 3, which it is very convenient.

What is claimed is:

1. A dual-purpose table with revolving tabletop comprising: a tabletop, a table support, and two surfaces of the tabletop are different modes; centers of short frames on both sides of the tabletop pivot on at least one baffle means via pivot components, the at least one baffle means is fixed on upper ends of the table support; an overturn positioning device is located on the baffle means that turns over the tabletop, said over turn positioning device comprising: an exterior frame, the exterior frame includes a panel and a hollow frame protruded from a rear of the panel, and a groove is located in the center of the panel; a connecting bar assembly set in the groove, said connecting bar assembly comprising a wrench, a support bar and an driving bar, tail ends of sidewalls of the wrench being pivotally connected with tail ends of sidewalls of the hollow frame, a rear of the support bar being pivotally connected with centers of sidewalls of the hollow frame, two ends of the driving bar being pivotally connected with sidewalls of the wrench and side walls of the support bar respectively, and a horizontal position of the support bar is a dead center position of the connecting bar assembly; wherein pushing the wrench toward the groove causes the support bar to extend horizontally, and pulling the wrench out of the groove causes the support bar to be withdrawn into the groove.

2. The dual-purpose table with revolving top of claim 1, further comprising a curved groove in an upper end of the wrench for the user pulling the wrench.

3. The dual-purpose table with revolving top of claim 1, wherein the support bar is pivotally connected with the hollow frame on a cylindrical roller, and each of the sidewalls of the wrench comprises a curved notch corresponding to the cylindrical roller.

4. The dual-purpose table with revolving top of claim 1, wherein said at least one baffle means comprises a first baffle means and a second baffle means, wherein said first baffle means comprises a first pair of over turn positioning devices, and said second baffle means comprises a second pair of over turn positioning devices.

* * * * *